US006185761B1

(12) United States Patent
Chapman et al.

(10) Patent No.: US 6,185,761 B1
(45) Date of Patent: Feb. 13, 2001

(54) APPARATUS FOR RAISING A PERSON

(75) Inventors: Christopher Chapman; David Lee Sandbach, both of Uxbridge (GB)

(73) Assignee: Cane & Able Limited, Chesterfield (GB)

( * ) Notice: Under 35 U.S.C. 154(b), the term of this patent shall be extended for 0 days.

(21) Appl. No.: 09/051,023

(22) PCT Filed: Sep. 27, 1996

(86) PCT No.: PCT/GB96/02400

§ 371 Date: Jun. 7, 1999

§ 102(e) Date: Jun. 7, 1999

(87) PCT Pub. No.: WO97/12578

PCT Pub. Date: Apr. 10, 1997

(30) Foreign Application Priority Data

Sep. 30, 1995 (GB) ..... 9519991
Sep. 13, 1996 (GB) ..... 9619237

(51) Int. Cl.[7] ..... A61G 1/00
(52) U.S. Cl. ..... 5/89.1; 5/81.1; 5/83.1
(58) Field of Search ..... 5/81.1, 83.1, 612, 5/89.1, 626; 297/452.14, 452.36, 452.28

(56) References Cited

U.S. PATENT DOCUMENTS 1,975,689 * 10/1934 Hall ..... 5/626
2,362,721 * 11/1944 Reynolds ..... 5/626
3,883,176 * 5/1975 Morton ..... 297/457
4,564,240 * 1/1986 Thieme ..... 297/457
4,852,945 * 8/1989 Rowles et al. ..... 297/458
4,977,630 * 12/1990 Oswalt et al. ..... 5/81 R

* cited by examiner

*Primary Examiner*—Terry Lee Melius
*Assistant Examiner*—Fredrick Conley
(74) *Attorney, Agent, or Firm*—Skjerven Morrill MacPherson LLP; Edward C. Kwok

(57) ABSTRACT

A system for raising a person lying on the ground includes a lifting seat 10 comprising a back rest 12 coupled to a seat portion 18. At either side of the back rest 12 and seat portion 18 there are provided side supports 14, 16, 20 and 22. The system is such that in use it can be slid onto a person lying on his/her side, rotated such that the back rest 12 lies on the ground, with the supports 14–22 supporting the person during rotation to a back-lying position. The back rest 12 can then be rotated upwardly to bring the person into a sitting position.

10 Claims, 5 Drawing Sheets

APPARATUS FOR RAISING A PERSON

The present invention relates to apparatus for raising a person, particularly from a lying position.

At present there are severe difficulties in dealing with people who fall either in public areas or in private areas, in particular people who are prone to fall such as the elderly and disabled. Raising people from the ground when in a partly or greatly incapacitated state simply by human force is strenuous and can be damaging to the person doing the lifting, especially when this is a frequent task.

Devices are known for raising people, which primarily involve hoists and slings. As well as being uncomfortable and degrading to the fallen person, they are not commonly available due to their bulk and cost. Their lack of availability can also cause problems such as pressure sores which can arise within half an hour if a person is lying awkwardly on a hard surface.

The present invention seeks to provide an improved raising system for raising a person from a lying position.

According to an aspect of the present invention, there is provided apparatus for raising a person lying on the ground as specified in claim 1.

In its simplest form, the apparatus can be a moulded plastics member of very simple form and therefore relatively cheap. The shape and structure of the apparatus is such that a person lying on the ground can be simply moved from a side-lying position to a back-lying position and then raised naturally to, for example, a sitting position. No straps or hoists are required in the preferred embodiment, thereby substantially reducing any degrading feeling.

Preferably, the apparatus includes a curved outer surface between the back rest and seat portion, enabling the apparatus to be tilted from the first position to the second position. Thus, the person can be simply raised from the back-lying position into a sitting position. In the preferred embodiment, the back rest is extended also to provide a support for the person's head and, in the preferred embodiment, to provide means by which a helper can raise the back rest to the upright position. It will be apparent that the centre of gravity of the person is not moved substantially and that a significant lever action is provided to reduce the lifting force required, thereby considerably reducing the effort need to be exerted by the helper.

Preferably, side supports are provided both on the back rest and seat positions. The side supports can ensure that the person can easily be tilted from a side-lying position to a back-lying position. Side supports on the seat portion of the apparatus allow the person's legs to be raised on tilting of the back rest to the first position.

Side supports are preferably provided on both sides of the back rest and/or seat portion, thereby enabling the apparatus to be used for a person lying on his/her left side or right side, without having to rotate the person to one or other of his/her left or right sides, as would be necessary with apparatus having side supports only on one side thereof.

In an embodiment, there is provided lifting means for lifting the back rest from the first position to the upright position. The lifting means could provide the entire lifting force required for raising the person or could provide an assisting force for reducing the lifting force required to be exerted by a helper.

When lifting means are provided, the back rest and seat portion are preferably in the form of a unitary member, the apparatus including a base pivotally coupled to the unitary member, a lifting means being disposed to act between the unitary member and the base.

The lifting means may be hydraulic, mechanical, electrical or of any other suitable form. The lifting means can include one or more fluid pressure struts or an inflatable bag.

There is preferably provided control means for controlling the amount of lift produced by the lifting means.

Means for locking the unitary member in the second position may be provided. The advantage of this is that the lifting means and/or helper need not exert any further lifting force on actuation of the locking means. The unitary member is preferably lockable into a plurality of upright positions, in dependence upon need and wishes of the user.

In a preferred embodiment, the seat portion is raised above ground level when the back rest is in the second position. This is preferably at a similar height to a wheelchair, such that the person can be slid directly onto a wheelchair or other chair without any further lifting of the person.

Preferably, at least one of the side supports is removable, thereby enabling the person to be slid sideways from the apparatus to a wheelchair or other chair.

According to another aspect of the present invention, there is provided apparatus for moving a person as specified in claim 10.

An embodiment of the present invention is described below, by way of example only, with reference to the accompanying drawings, in which.

Figure 1:
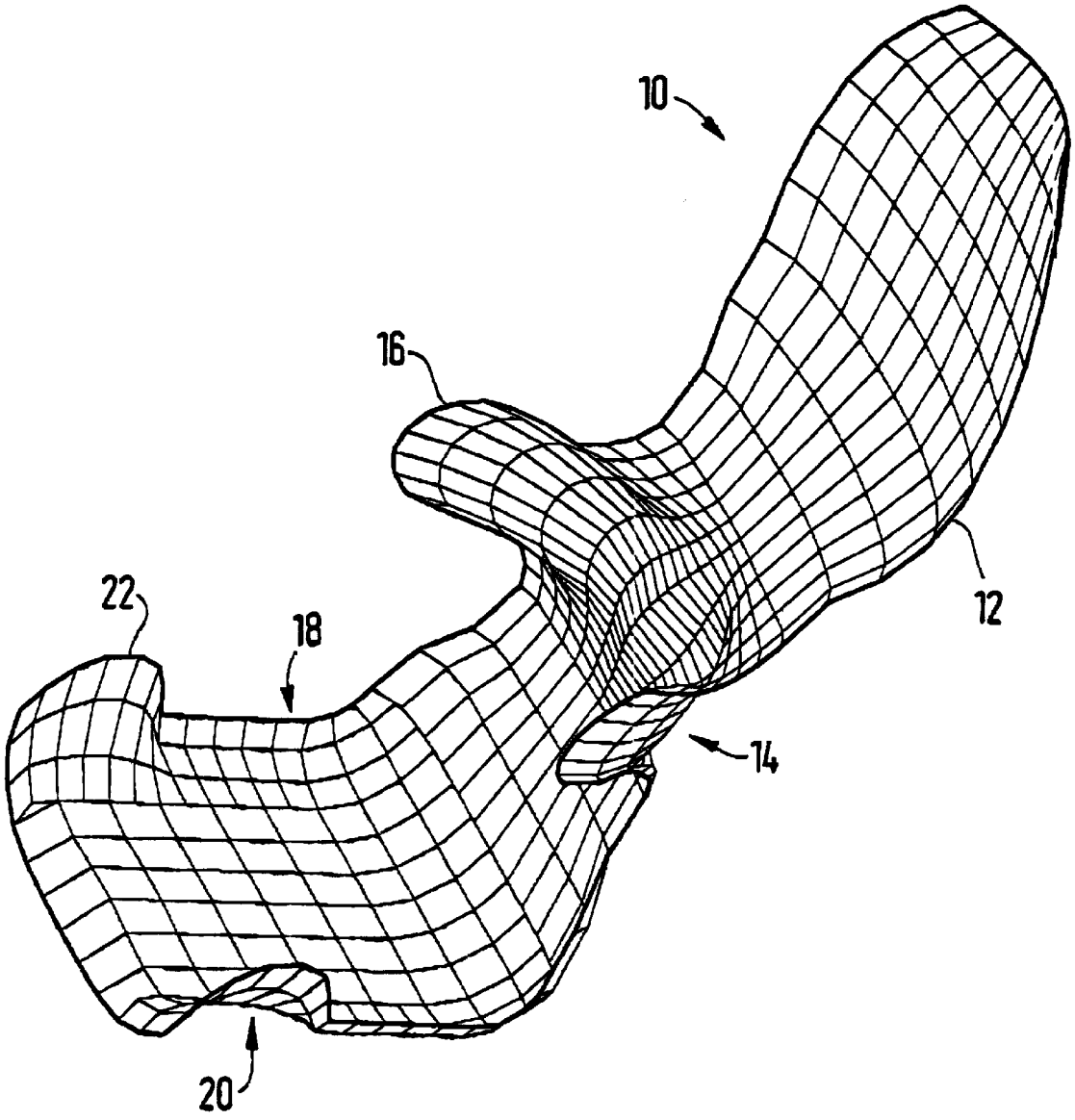
FIG. 1 is a schematic diagram in perspective of an embodiment of person raising apparatus.

Referring to FIG. 1, the embodiment of apparatus shown (hereinafter referred to as the lifting seat) is formed of a unitary piece of material, preferably plastics material, which is relatively thin and contoured to provide the various operating portions of the seat 10.

The seat 10 includes a back rest 12 which is slightly concave when viewed from its front side. At an intermediate position along the back rest 12, there are provided two side supports 14, 16 which extend towards the front of the back rest 12.

At seat portion 18 extends from the lower end of the back rest 12 and is also provided with side supports 20, 22. The seat 10 is also curved between the back rest 12 and seat portion 18. One or more of the side supports 14, 16, 20, 22 may be omitted in other embodiments. For example, in a simpler version, side supports may be provided only on one side of the lifting seat 10. Similarly, the side support(s) on the back rest 12 or those on the seat portion 18 may be omitted.

Figure 2:
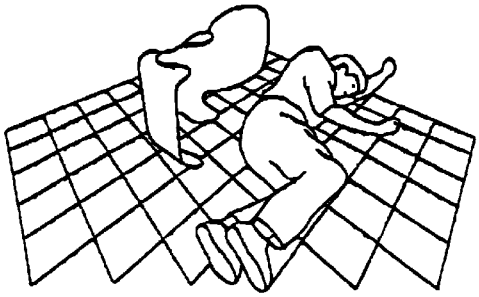
FIGS. 2 to 7 are views of the apparatus of FIG. 1 during its use to raise a person lying on the ground.

Referring to FIG. 2, the lifting seat 10 is designed to lift a person who has fallen to the ground and is unable to raise himself/herself. With the design of seat shown in FIG. 1, the person is first moved to a "recovery" position, that is on his/her side with knees raised to be in front of the person, thereby to place the person in a resting position. This "recovery" position is common in situations of this kind.

Figure 3:
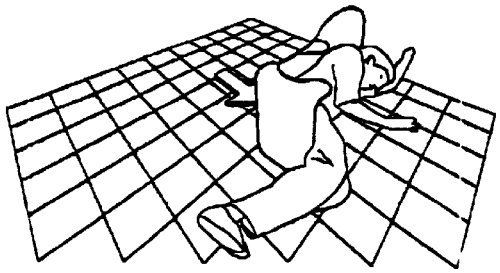
Figure 4:
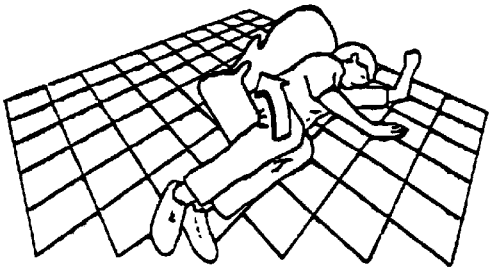
Figure 5:
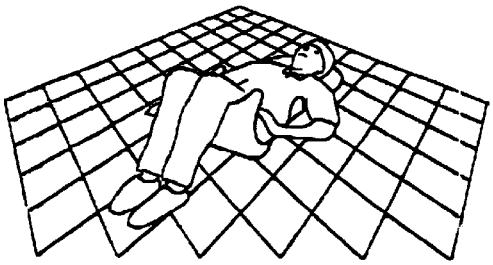
Figure 6:
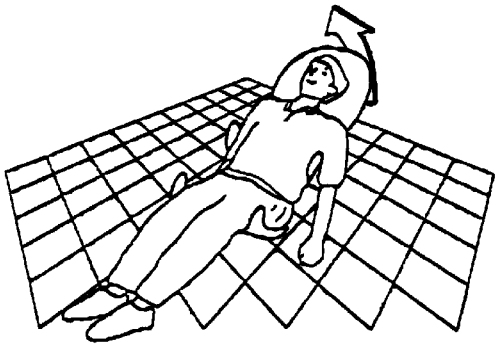

As can be seen in FIG. 3, the lifting seat 10 is placed on its side against the ground and then slid towards the lying person, such that the relevant side supports 14–22 are slid underneath the person. As shown in FIG. 4, the lifting seat 10 is then rotated on the back rest 12, the side supports 14–22 supporting the person during the rotating action, thereby to rotate the person to a position in which the person is lying on his/her back with knees raised, as can be seen in FIG. 5.

Figure 7:
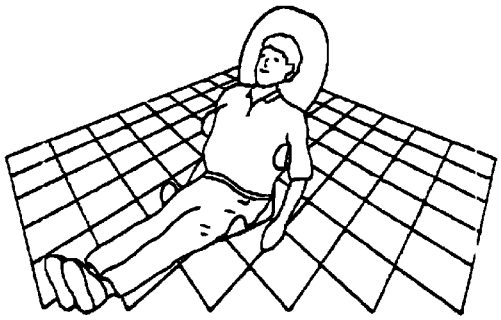

The lifting seat 10 can then be rotated onto the seat portion 18 so as to bring the back rest 12 into a substantially upright position, as shown in FIG. 7. For this purpose, the back rest 12 is preferably of a sufficient length both to support the person's head and also to provide a gripping member to be used by a helper raising the person.

It will be apparent from FIG. 7 that the weight of the person on the seat portion 18 will enable the person to rest on the lifting seat 10 in the sitting position thereby to assist recovery of the person or subsequent moving of the person by nurses or other people.

The centre of gravity of the person remains relatively unchanged during the operation shown in FIGS. 2 to 7. This substantially reduces the rotating and lifting forces which must be exerted by a helper and thereby enables a single helper, even an aged person, to raise the fallen person.

The front, support surface of the lifting seat 10 is preferably covered with a relatively soft material for comfort. The rear surface of the lifting seat 10 is, as will be apparent from FIGS. 1 to 7, contoured in facilitate rotation of the lifting seat both sideways and into the upright position.

In the preferred embodiment, the front support surface of the lifting seat 10 is designed such that a person can slide relatively easily sideways across the support surface but cannot slide lengthways down the seat 10. The latter feature can be particularly useful when the side supports 14, 16 do not support the person in a vertical direction in the manner shown in the embodiment of FIG. 7.

Suitable material for the support surface of the lifting seat 10 may be a velour material suitably oriented, or a ribbed surface. Other materials and shapes will be apparent to the skilled person.

Figure 8:
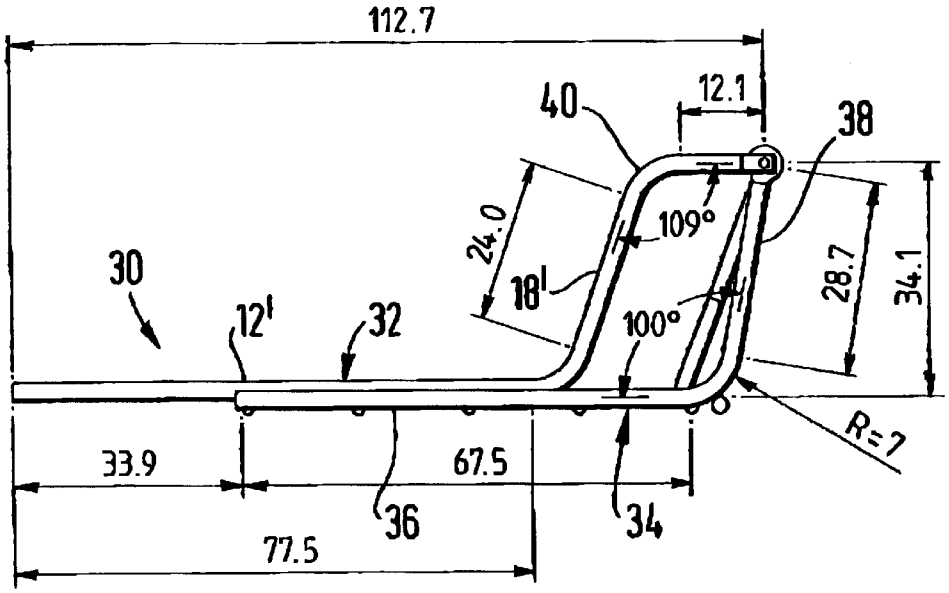
FIG. 8 is a side elevational view of a second embodiment of person raising apparatus.

Another embodiment of lifting seat 30 is shown in FIGS. 8 to 12. In this embodiment, a seat portion 32 has a similar shape and configuration to the lifting seat 10 shown in FIGS. 1 to 7. In FIG. 8, the side supports 14–22 are not shown but could also be provided.

The seat portion 32 is pivotally coupled to a base member 34, which includes a ground support 36 and a side member 38 integral with the base member 34. The side member 38 is pivotally coupled to a flange 40 depending from the seat portion 18' of the seat portion 32.

Figure 9:
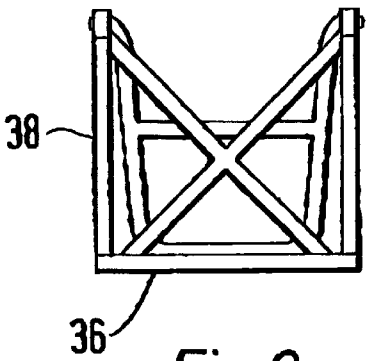
FIG. 9 is a base view of the apparatus of FIG. 8.
Figure 10:
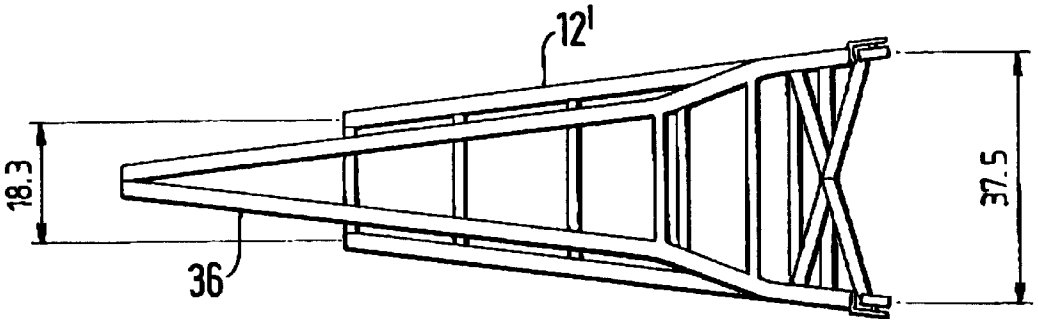
FIG. 10 is a rear view of the apparatus of FIG. 8.

FIGS. 9 and 10 show that the embodiment of lifting seat 30 is formed from a plurality of tubular or rod sections to reduce weight of the device. Although in FIG. 9 the base member is shown to be rectangular, it may be curved to facilitate rotation of the lifting seat 30.

The lifting seat 30 is provided with a lifting mechanism which lifts the seat portion 32 relative to the base member 34. This can be seen from FIG. 11, in which the lifting mechanism is an inflatable air bag 42. The air bag can be inflated by any suitable means, for example a gas cylinder, electrical or other automatic pump, or a mechanical pump.

Figure 11:
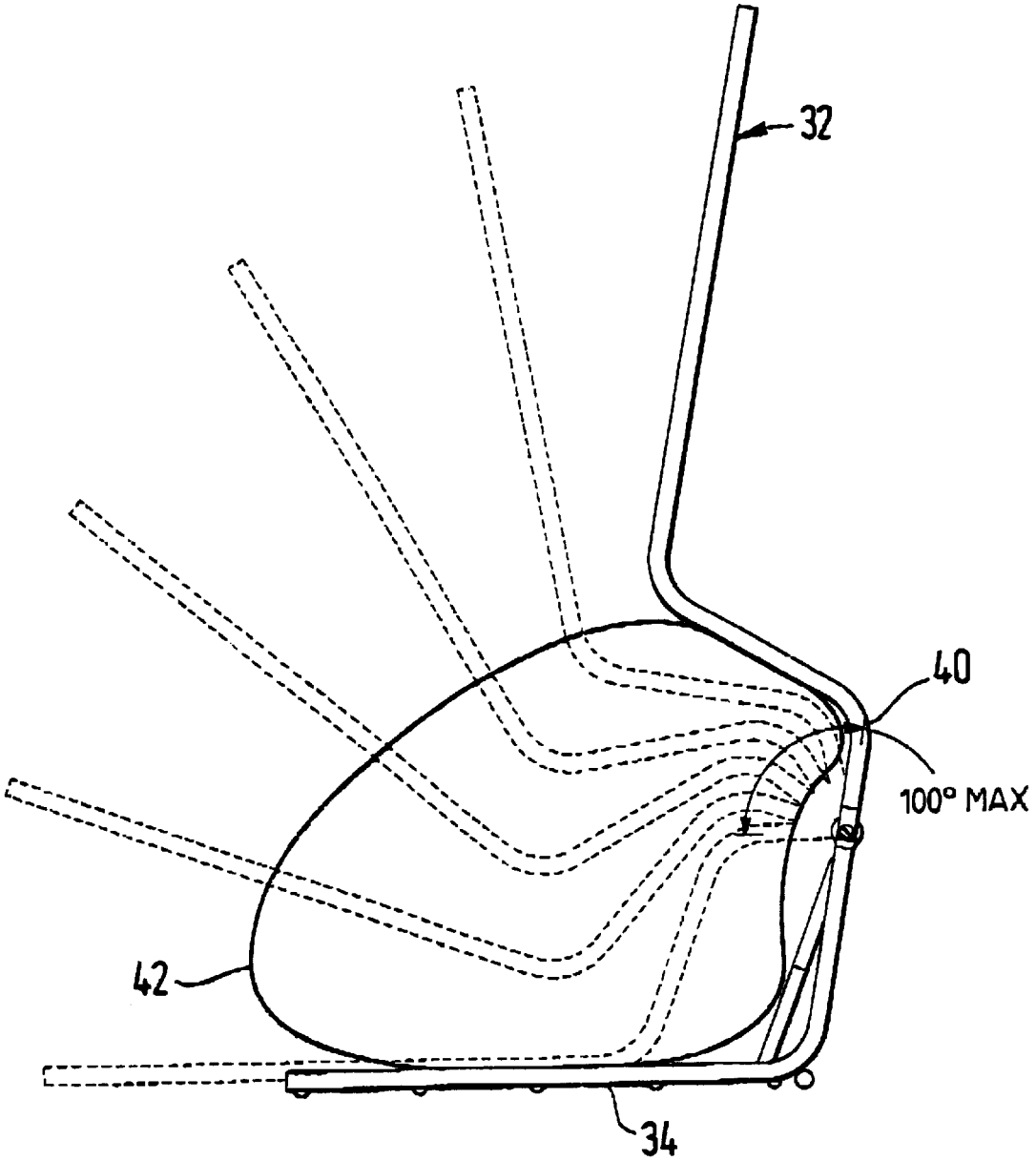
FIG. 11 is a schematic diagram of the apparatus of FIG. 8 showing various degrees of lifting of a support member of the apparatus.

As can be seen in FIG. 11, as the bag inflates, it applies pressure between the base member 34 and seat portion 32, causing the seat portion 32 to pivot gradually towards an upright position.

Other raising mechanisms include a hydraulic jack, which may be hand operated, of gas strut, which could be used by itself or in combination with another lifting mechanism such as the air bag, a pressurized gas cylinder in combination with the air bag 42 and so on.

FIG. 11 shows that in the preferred embodiment the angle of the flange 40 relative to the horizontal is preferably no more than 100°, although this maximum angle is dependent entirely upon the application and user requirements. In the preferred embodiment, a controller (not shown) controls the raising of the seat portion 32 and enables seat portion 32 to be stopped at any suitable angle.

The air bag 42 may have a plurality of air chambers. This can facilitate control of the air bag during inflation and can provide show deflation, for example should it be punctured.

A lock, latch or the like may be provided to lock the seat portion 32 in the upright position, thereby ending the need for any lifting action by the lifting means. In the preferred embodiment, the lock, latch or other system is preferably of such type that the seat portion 32 can be locked in a plurality of different positions, possibly in an infinite number of angles. With such a feature, the air bag 42 may be removable for use with other devices. As the air bag and pressurization system represent a substantial proportion of the cost of such a system, this can reduce overall cost.

Figure 12:
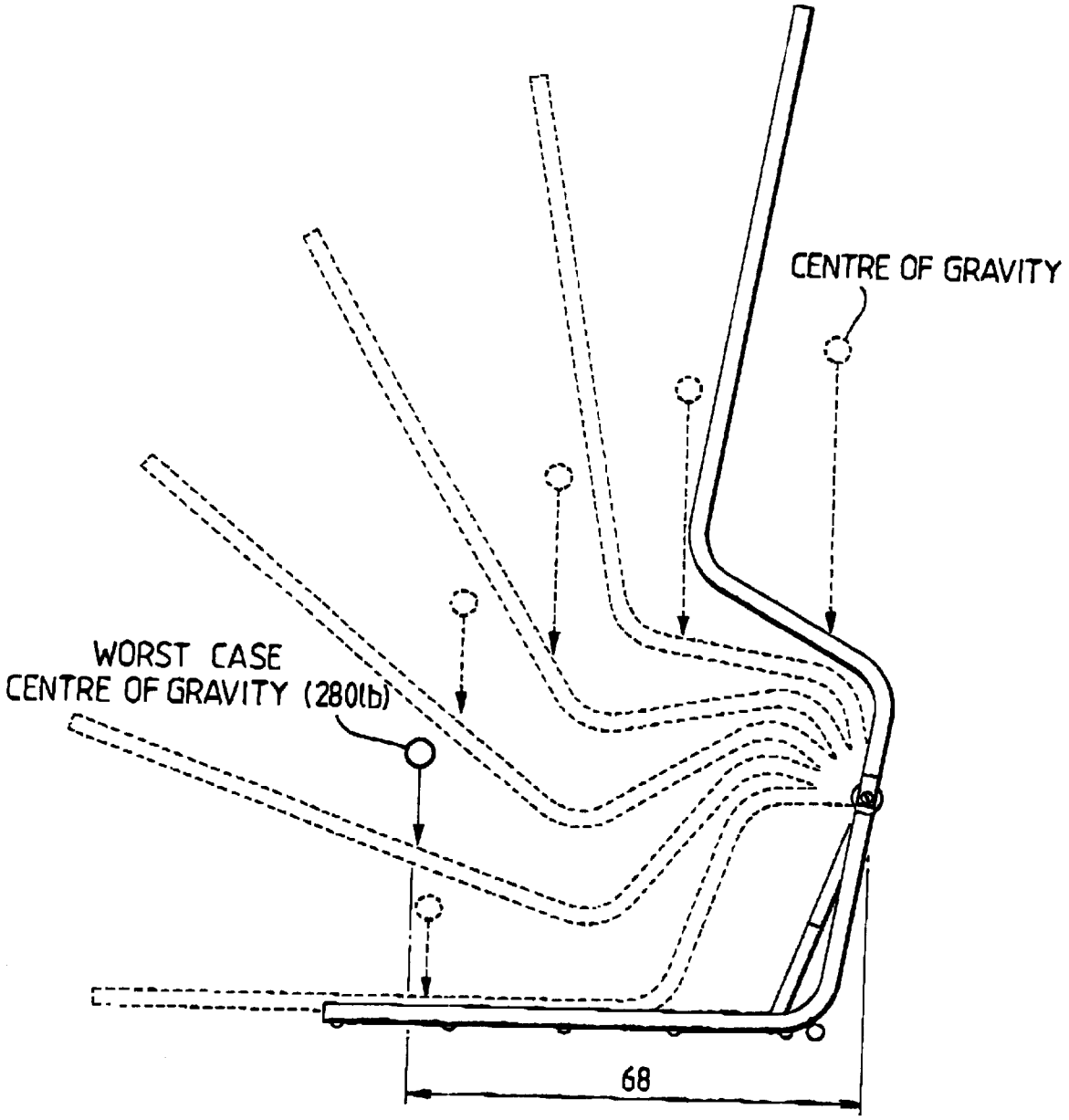
FIG. 12 is a view similar to FIG. 11 showing the change in the centre of gravity of a person.

As can be seen in FIG. 12, the lifting seat 30 raises the centre of gravity of the person in the seat, thereby carrying out most of the lifting action required to bring the person into a normal sitting position. This sitting position is preferably such that the person in the seat can be slid into a wheelchair or other chair without any further lifting being required. In this case, any side supports provided on seat portion 32 are preferably removable to allow lateral sliding of the person on the lifting seat 30.

In the embodiment of FIGS. 8 to 12, there may be provided as sensor mechanism which does not allow raising of the seat portion 32 until the lifting seat 30 is detected to be in the back-lying position shown in FIG. 8. The skilled reader would immediately be able to identify suitable sensors for this purpose.

In both embodiments described herein, there may be provided a belt or strap to secure the person into the seat.

The embodiment of FIGS. 8 to 12 can be modified for other applications, for example any application in which a person requires assistance in moving from a substantially lying position to a substantially upright position. Typical applications may be for a reclining chair for use by an elderly or disabled person; in a bed, to assist a person to get up from the bed; or in a bath or the like.

The dimensions given in Figures, which are in centimetres, are for illustration only.

The disclosures in British patent application Nos. 9519991.5 and 9619237.2, from which this application claims priority, and in the abstract accompanying this application are incorporated herein by reference.

What we claim is:

1. Apparatus for raising a person lying on the ground including:

a back rest having a curved rear surface allowing the apparatus to be tilted from a first position in which the back rest lies on the ground to a second position in which the back rest is in a substantially upright position;

a seat portion disposed at an angle to the back rest; and a side support on the back rest or the seat portion, the side support being slidable under the person when the apparatus is placed in the first position.

2. Apparatus according to claim 1, wherein the side support is provided on both sides of the back rest or the seat portion.

3. Apparatus according to claim 1, including lifting means for lifting the back rest from the first position to the upright position.

4. Apparatus according to claim 3, wherein the back rest and seat portion are in the form of a unitary member, the apparatus including a base pivotally coupled to the unitary member, the lifting means being disposed to act between the unitary member and the base.

5. Apparatus according to claim 4, wherein the lifting means includes a fluid pressure strut.

6. Apparatus according to claim 3, including control means for controlling the amount of lift produced by the lifting means.

7. Apparatus according to claim 3, including locking means to lock the unitary member in the second position.

8. Apparatus according to claim 1, wherein the seat portion is raised above ground level when the back rest is in the second position.

9. Apparatus according to claim 1, wherein the side support is removable.

10. Apparatus according to claim 4, wherein the lifting means includes an inflatable bag.

* * * * *